US009633607B1

(12) United States Patent
Aubert et al.

(10) Patent No.: US 9,633,607 B1
(45) Date of Patent: Apr. 25, 2017

(54) ADAPTIVE RGBW CONVERSION

(71) Applicant: Amazon Technologies, Inc., Reno, NV (US)

(72) Inventors: Jozef Elisabeth Aubert, Roermond (NL); Henricus Petronella Maria Derckx, Weert (NL); Johannes Wilhelmus Hendrikus Mennen, Budel (NL)

(73) Assignee: Amazon Technologies, Inc., Seattle, WA (US)

( * ) Notice: Subject to any disclaimer, the term of this patent is extended or adjusted under 35 U.S.C. 154(b) by 253 days.

(21) Appl. No.: 14/094,159

(22) Filed: Dec. 2, 2013

(51) Int. Cl.
*G09G 3/20* (2006.01)
*G09G 3/34* (2006.01)
*G09G 3/36* (2006.01)

(52) U.S. Cl.
CPC ..... *G09G 3/3406* (2013.01); *G09G 3/2003* (2013.01); *G09G 3/344* (2013.01); *G09G 3/348* (2013.01); *G09G 3/3607* (2013.01); *G09G 2300/0452* (2013.01); *G09G 2300/0456* (2013.01); *G09G 2320/0242* (2013.01); *G09G 2320/0646* (2013.01); *G09G 2360/141* (2013.01)

(58) Field of Classification Search
CPC ..... G09G 3/20; G09G 3/2003; G09G 3/2074; G09G 3/34–3/3426; G09G 3/3433; G09G 3/348; G09G 3/36–3/3607; G09G 3/38; G09G 2300/0439–2300/0465; G09G 2340/06; G09G 2320/0242; G09G 2320/0646; G09G 2360/141
See application file for complete search history.

(56) References Cited

U.S. PATENT DOCUMENTS

| | | | | |
|---|---|---|---|---|
| 2005/0190142 | A1* | 9/2005 | Ferguson | G09G 3/3406 345/102 |
| 2006/0256067 | A1* | 11/2006 | Montero | G09G 3/3406 345/102 |
| 2008/0084524 | A1* | 4/2008 | Inuzuka et al. | 349/108 |
| 2008/0303918 | A1* | 12/2008 | Keithley | 348/223.1 |
| 2009/0135207 | A1* | 5/2009 | Tseng et al. | 345/690 |

* cited by examiner

*Primary Examiner* — Nathan Danielsen
(74) *Attorney, Agent, or Firm* — Lee & Hayes, PLLC

(57) ABSTRACT

The subject matter disclosed herein relates to conversion of RGB image data into RGBW image data for display by an image display apparatus. The image display apparatus accesses Red Green Blue (RGB) image data that corresponds to one or more images to be displayed by a Red Green Blue White (RGBW) display of the image display apparatus. The image display apparatus receives one or more inputs. Based upon the one or more external factors, the RGB image data is converted into RGBW image data. Based upon the RGBW image data, the RGBW display displays the one or more images.

20 Claims, 3 Drawing Sheets

ADAPTIVE RGBW CONVERSION

BACKGROUND

Many portable electronic devices include displays for displaying various types of images. Examples of such displays include electrowetting displays (EWDs), liquid crystal displays (LCDs), electrophoretic displays (EPDs), light emitting diode displays (LED displays), etc. The amount of brightness and color of ambient light can affect the quality and performance of the displays. For example, when there is a large amount of ambient light, such as, for example, outside on a sunny day, depending upon the type of screen, images may be hard to view by a user. Likewise, when there is a small amount of ambient light, such as, for example, outside on cloudy days, images may also be difficult for a user to view.

BRIEF DESCRIPTION OF THE DRAWINGS

The detailed description is described with reference to non-limiting and non-exhaustive embodiments illustrated in the accompanying figures. The same reference numerals in different figures refer to similar or identical items.

DETAILED DESCRIPTION

Overview

Figure 1:
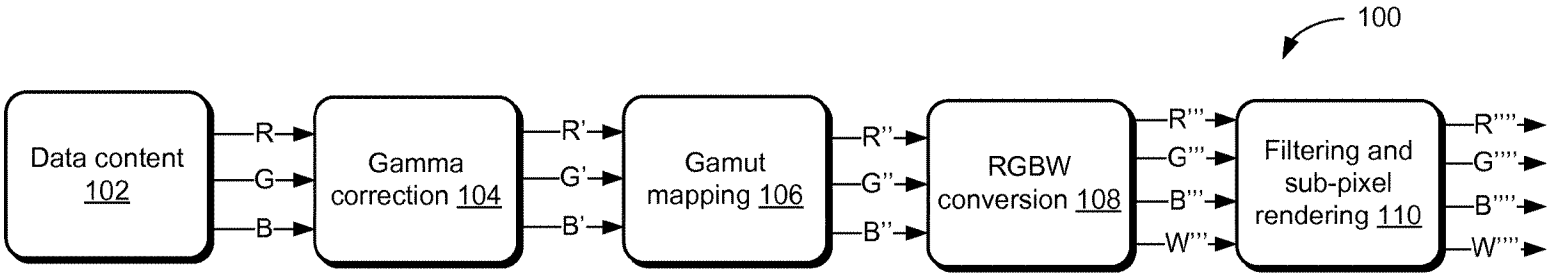
FIG. 1 is a schematic view of conversion of RGB image data into RGBW image data, according to various embodiments.

The present disclosure provides techniques and systems that provide for dynamic control of color mapping and light contribution for conversion of Red Green Blue (RGB) image data into Red Green Blue White (RGBW) image data, where the resulting RGBW image data is utilized to display images on an RGBW display of an image display apparatus. Furthermore, the present disclosure also provides techniques and systems for providing control of light in various electrowetting displays when an optional light source is used.

In general, image display apparatuses, such as, for example, various electronic devices, including, but not limited to, portable computing devices, tablet computers, laptop computers, notebook computers, mobile phones, personal digital assistants (PDAs), and portable media devices (e.g., e-book devices, DVD players, etc.), display images on a display based upon RGB image data. When the image display apparatus includes an RGBW display, the RGB image data is converted to RGBW image data to be used by the RGBW display. Examples of RGBW displays include, but are not limited to, LCDs, EWDs and EPDs.

An electrowetting display employs an applied voltage to change the surface tension of a liquid in relation to a surface. For instance, by applying a voltage to a hydrophobic surface, the wetting properties of the surface can be modified so that the surface becomes increasingly hydrophilic. As one example of an electrowetting display, the modification of the surface tension acts as an optical switch by contracting a colored oil film when a voltage is applied to individual pixels of the display. When the voltage is absent, the colored oil forms a continuous film within a pixel, and the color may thus be visible to a user of the display. On the other hand, when the voltage is applied to the pixel, the colored oil is displaced and the pixel becomes transparent. When multiple pixels of the display are independently activated, the display can present a color or grayscale image. The pixels may form the basis for a transmissive, reflective, or transmissive/reflective (transreflective) display. Further, the pixels may be responsive to high switching speeds (e.g., on the order of several milliseconds), while employing small pixel dimensions. Accordingly, the electrowetting displays herein may be suitable for applications such as displaying video content. In addition, the lower power consumption of electrowetting displays in comparison to conventional LCD displays makes the technology suitable for displaying content on portable display devices that rely on battery power.

In an embodiment, an electrophoretic display moves particles between different positions to achieve different color shades. For instance, in a pixel that is free from a color filter, the pixel may be configured to produce white when the particles within this pixel are located at the front (i.e., viewing) side of the display. When situated in this manner, the particles reflect incident light, thus giving the appearance of a white pixel. Conversely, when the particles are pushed near the rear of the display, the display absorbs the incident light and, hence, causes the pixel to appear black to a viewing user. In addition, the particles may situate at varying locations between the front and rear sides of the display to produce varying shades of gray. Furthermore, as used herein, a "white" pixel may comprise any shade of white or off white, while a "black" pixel may similarly comprise any shade of black.

In another embodiment, an electrophoretic display includes oppositely charged light and dark particles. In order to create white, the display controller moves the light particles to the front side of the display by creating a corresponding charge at an electrode near the front and moves the dark particles to the back of the display by creating a corresponding charge at an electrode near the back. In order to create black, meanwhile, the controller changes the polarities and moves the dark particles to the front and the light particles to the back. Furthermore, to create varying shades of gray, a controller may utilize different arrays of both light and dark particles. In some cases, the particles may be contained in tiny individual transparent capsules, such as approximately 40 micrometers in diameter. The capsules are suspended in a fluid, such as a liquid polymer, between a transparent upper electrode grid layer and a lower electrode grid layer separated by a gap, such as approximately 50-200 micrometers. Color filters may be included to provide various types of colors.

As is known, each pixel of an image for display may be represented by a set of Red Green Blue (RGB) subpixel components (e.g., color channels) that describe the color of the pixel based on the red, green, and blue primary colors. In some implementations, each of the R, G, and B subpixel components comprises an 8-bit binary number that corresponds to the brightness of the individual primary colors.

Subpixel rendering is the process of breaking apart a single pixel on a display screen into the component colors (RGB) that, in various intensities, combine to create the perceived color. The result of using subpixels to render an image is that angles and curves may appear smoother because units of display smaller than a standard pixel are used to fill areas where there might otherwise be only a solid pixel or no pixel at all. The process of subpixel rendering is most often used to improve the appearance of fonts on displays. Other applications, such as sharpening an image or improving the appearance of vector-based graphics, have also been developed.

The basic premise behind subpixel rendering has to do with how some displays display information. When an image is displayed on the display, it is made up of many small dots known as pixels. Each of these pixels can be one of millions of colors, depending on the display technology. The individual pixel that most users see only as a single dot is actually made from three or more smaller dots (subpixels), each of which can only illuminate in a single color, usually red, green or blue. The combination of these colors determines the final color that is seen as a single pixel.

By manipulating the subpixels of a larger pixel, more gradual gradations are able to be achieved when rendering an image. The end result is that the space that would normally be unoccupied by a whole pixel can be only partially filled in with a subpixel, creating the illusion of a smooth line. Subpixel rendering is often compared to another image processing technique known as anti-aliasing, which can sometimes achieve the same effect, though usually on a larger scale.

RGBW technology adds an extra subpixel to the traditional red, green and blue subpixels that is a clear area without color filtering material and with the primary purpose of letting backlight come through, hence W for white. This generally makes it possible to produce a brighter image compared to an RGB-matrix, while using the same amount of power, or produce an equally bright image while using less power.

Thus, an RGBW display is a display that is configured to display RGBW image data and possibly convert RGB image data to RGBW image data, as described herein. More particularly, an RGBW display is a display that adds white light on a traditional RGB display. Because the white light does not need a color filter, the RGBW display can generally provide higher luminance than a traditional RGB display and may reduce power consumption of a backlight source. Compared to the RGB display, the RGBW display generally has two advantages: 1. the RGBW display can generally provide higher luminance at the same power; and 2. the power consumption of the RGBW display is generally lower than the RGB display for the same luminance. While the RGBW display generally increases luminance of images, the RGBW display generally reduces color saturation of the images.

FIG. 1 illustrates an example of a process 100 for converting data content 102, in the form of RGB image data, to RGBW image data. A gamma correction block 104 receives a set of RGB subpixel components and applies a gamma correction to the set of RGB subpixel components. Gamma correction generally involves applying a nonlinear operation to the set of RGB subpixel components. Such an operation can be described mathematically, for example, as $R'G'B'=A(RGB)^{gamma}$, where A is a constant, gamma is an exponent that is larger than or equal to 1, and R'G'B' is a set of gamma corrected RGB subpixel components.

As is known, a gamut mapping block 106 receives the corrected set of RGB subpixel components, R'G'B', and maps the R'G'B' subpixel components into a color gamut to compensate for, among other things, properties of human vision. As an example, the mapping function performs an operation that can be described mathematically as 1/(1+a), where a=max(R'G'B')−2*min(R'G'B'). The resulting R"G"B" subpixel components are provided to an RGBW conversion block 108 that adds a fourth component, W'", to provide RGBW image data. The fourth component W'" represents brightness of a white subpixel component that is included in RGBW image data for displaying by RGBW displays. More particularly, the white subpixel component, W'", is added to the R"G"B" subpixel components to allow for controlling amounts of luminance and saturation in images displayed by an RGBW display.

The RGBW conversion block 108 modifies the R"G"B" subpixel components to account for the white subpixel component, W'", resulting in a set of R'"G'"B'"W'" subpixel components that are provided to a filtering and subpixel rendering block 110 to produce R""G""B""W"" subpixel components. As is known, the filtering and subpixel rendering block 110 generally operates based on physical characteristics of the display of the image display apparatus to be used to display an image based upon the resulting RGBW image data.

The contribution of white subpixel components included in the RGBW image data generally affects the overall brightness and color of the resulting image displayed on the RGBW display. Thus, a greater contribution of white subpixel components included in the RGBW image data can cause images displayed to appear lighter, while a lower contribution of white subpixel components included in the RGBW image data can cause images displayed to appear darker. Depending upon the environment in which the image display apparatus is being utilized, the amount of brightness and color for images being displayed needs to be controlled. For example, based upon the amount of ambient light and color in the environment of the image display apparatus, a user may desire for images to be displayed with lower or higher overall brightness or saturation.

In accordance with various embodiments of the present disclosure, in order to help control the brightness and color of displayed images, an ambient light sensor is included with the image display apparatus. The ambient light sensor detects the color and/or the amount of ambient light and provides information relating to the amount of ambient and/or color of the light to an RGBW image processor of the image display apparatus that includes an RGBW controller and an RGBW converter. In accordance with various embodiments, the RGBW controller and RGBW converter are a single entity.

Based upon the information received by the RGBW image processor from the ambient light sensor, the RGBW controller provides control information to an RGBW converter of the image display apparatus. Based upon the control information received by the RGBW converter from the RGBW controller, the RGBW converter controls the contribution of white subpixel components output in the RGBW image data from the RGBW converter. The RGBW image data is provided to the RGBW display of the image display apparatus. Thus, based upon the contribution of white subpixel components included in the RGBW image data, the resulting images displayed by the RGBW display are adjusted with respect to brightness.

Additionally, in electrowetting displays, one or more additional light sources for use in displaying images may be included in the electrowetting displays. The type of electrowetting display determines the type of optional light source included in the display. For example, a reflective electrowetting display generally may include a front light source. Thus, depending upon the information received by the RGBW controller from the ambient light sensor, the intensity of the front light source can be controlled to control the brightness of resulting images displayed by the reflective electrowetting display. Likewise, a transmissive electrowetting display generally may include a back light source. Thus, the RGBW controller can use information received from the ambient light sensor to control the intensity of the back light source to control the brightness of resulting images displayed by the transmissive electrowetting display. A transflective electrowetting display generally may include a front light source and/or a back light source (most likely just a back light source) that can be controlled by the RGBW controller based upon the information received from the ambient light sensor to control the brightness of resulting images displayed by the transflective electrowetting display.

In accordance with various embodiments, user input may also be utilized by the RGBW controller to control the contribution of white and RGB subpixel components included in the RGBW image data based upon a user's desire to increase or decrease the brightness of resulting images on the display. Likewise, user input can also be used to control front light sources and/or back light sources in electrowetting displays.

Illustrative Structures and Processes

Figure 2:
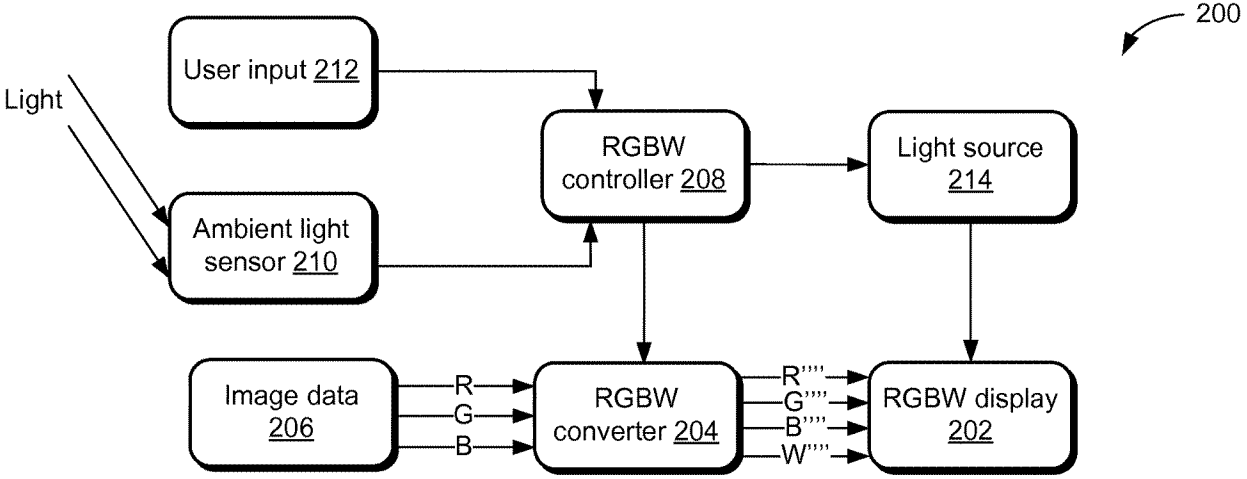
FIG. 2 is a schematic view of an image display apparatus, according to various embodiments.

FIG. 2 schematically illustrates an image display apparatus 200. The image display apparatus 200 generally includes an RGBW display 202 for displaying images based upon RGBW image data. The image display apparatus 200 also includes an RGBW converter 204 that receives image data 206 in the form of RGB image data corresponding to images for display on the RGBW display 202 and converts the received RGB image data into R""G""B""W"" image data. The image data 206 can be provided to the RGBW converter 204 from various sources, such as, for example, memory included on the image display apparatus 200, an external source, such as, for example, the Internet, a network accessible computing platform (often referred to as the "cloud"), etc. The image display apparatus 200 also includes an RGBW controller 208. The RGBW converter 204 and an RGBW controller 208 form an image processor. In accordance with various embodiments, the RGBW converter 204 and the RGBW controller 208 are a single entity. In various embodiments, the RGBW converter 204 and the RGBW controller 208 are implemented in one or more processors, processing cores, graphics processing units (GPUs), digital signal processors (DSPs), application-specific integrated circuits (ASICs), software and/or firmware.

For clarity, a gamma correction portion, a gamut mapping portion and a filtering and sub-pixel rendering portion, as briefly described with respect to FIG. 1, are not illustrated and described as part of the image processor since such portions and associated techniques are well known. One or more of such portions may be included within or separately from the RGBW converter 204. Additionally, one or more of the components, and their associated functions described herein, may be located remotely from the image display apparatus 200.

The image display apparatus 200 may also include an ambient light sensor 210 and a user input 212. The RGBW controller 208 receives information from, for example, the ambient light sensor 210 and/or the user input 212. The information provided to the RGBW controller 208 can be used to control conversion of RGB data by the RGBW converter 204 into RGBW data. In general, the ambient light sensor 210 is included on the image display apparatus 200 in close proximity to the RGBW display 202.

The RGBW display 202 can be, for example, a liquid crystal display, an electrowetting display or an electrophoretic display. As is known, an electrowetting or LCD display can be a reflective display that may include an optional front light source, a transmissive display that includes an optional back light source, or a transflective display that includes an optional front light source and/or an optional back light source. In general, electrophoretic displays do not include such front and/or back light sources.

In accordance with the various embodiments, the RGBW controller 208 is also configured to control a front light source and/or back light source within electrowetting displays to control displaying of images by the RGBW display 202. Such control of the front light source and/or the back light source can be based upon information received by the RGBW controller 208 from the ambient light sensor 210 and/or the user input 212.

For clarity, only one light source 214 is illustrated in FIG. 2. The light source 214 can schematically represent a front light source, a back light source, or a front light source and a back light source or other types of light sources depending upon the type of electrowetting display device represented by the RGBW display 202. The light source 214 can be an LED or other suitable type of light source.

Thus, in accordance with various embodiments of the present disclosure, based upon an input, such as, for example, the amount of ambient light sensed by the ambient light sensor 210 or input from the user input 212, the RGBW controller 208 sends information to control the RGBW converter 204 in order to control the contribution of white and RGB subpixel components to the RGB image data when converting the RGB image data into RGBW image data. Thus, depending upon the inputs, the RGBW controller 208 controls the RGBW converter 204 to control the contribution of white and/or RGB subpixel components included in the RGBW image data in order to control amounts of luminance and saturation in images displayed by the RGBW display 202.

For example, in embodiments where the RGBW display 202 is a reflective electrowetting display that includes a front light source 214, if the ambient light sensor 210 senses a low light environment, i.e., cloudy conditions, and provides this information to RBGW controller 208, then RGBW controller 208 will instruct the RGBW converter 204 to increase the contribution of white subpixel components included in the RGBW image data that is generated by the RGBW converter 204. Alternatively, if the ambient light sensor senses a well-lit environment, i.e., sunny conditions, then the RGBW controller 208 instructs the RGBW converter 204 to lower the contribution of white subpixel components included in the RGBW image data. The RGBW controller 208 can also receive input from the user input 212 wherein a user of the image display apparatus 200 has requested either an increase or a decrease in the overall brightness of images displayed by the RGBW display 202 (a reflective electrowetting display in this example). The RGBW controller 208 can use the information received from user input 212 to instruct the RGBW converter 204 accordingly as to the contribution level of the white subpixel components in the RGBW image data. Finally, since in this example the RGBW display 202 is a reflective electrowetting display that includes a front light source 214, the RGBW controller 208 can also use input from the ambient light sensor 210 and/or the user input 212 to control front light source 214.

In an embodiment where the RGBW display 202 is a reflective display, e.g. LCD or electrowetting display, that does not include an optional light source 214, the RGBW controller 208 can also use input from the ambient light sensor 210 and/or the user input 212 to control the contribution of white subpixel components included in the RGBW image data that is generated by the RGBW converter 204. For example, if the ambient light sensor 210 senses a low light environment, i.e., cloudy conditions, and provides this information to RBGW controller 208, then RGBW controller 208 will instruct the RGBW converter 204 to increase the contribution of white subpixel components included in the RGBW image data that is generated by the RGBW converter 204. Alternatively, if the ambient light sensor senses a well-lit environment, i.e., sunny conditions, then the RGBW controller 208 instructs the RGBW converter 204 to lower the contribution of white subpixel components included in the RGBW image data. The RGBW controller 208 can also receive input from the user input 212 wherein a user of the image display apparatus 200 has requested either an increase or a decrease in the overall brightness of images displayed by the RGBW display 202 (a reflective electrowetting display in this example). The RGBW controller 208 can use the information received from user input 212 to instruct the RGBW converter 204 accordingly as to the contribution level of the white subpixel components in the RGBW image data.

As another example, in embodiments where the RGBW display 202 is a transmissive electrowetting display that includes a back light source 214, if the ambient light sensor 210 senses a low light environment, i.e., cloudy conditions, and provides this information to RBGW controller 208, then RGBW controller 208 will instruct the RGBW converter 204 to decrease the contribution of white subpixel and adapts the RGB components included in the RGBW image data that is generated by the RGBW converter 204. Alternatively, if the ambient light sensor senses a well-lit environment, i.e., sunny conditions, then the RGBW controller 208 instructs the RGBW converter 204 to increase the contribution of white subpixel components and adapts the RGB components included in the RGBW image data. The RGBW controller 208 can also receive input from the user input 212 wherein a user of the image display apparatus 200 has requested either an increase or a decrease in the overall brightness and color of images displayed by the RGBW display 202 (a transmissive electrowetting display in this example). The RGBW controller 208 can use the information received from user input 212 to instruct the RGBW converter 204 accordingly as to the contribution level of the white subpixel and RGB components in the RGBW image data. Finally, since in this example the RGBW display 202 is a transmissive electrowetting display, the RGBW controller 208 can also use input from the ambient light sensor 210 and/or the user input 212 to control back light source 214.

In embodiments where the RGBW display 202 is a transflective display that includes both a front light source and a back light source, then the RGBW controller 208 can receive input based upon various factors such as, for example, the ambient light sensor 210 and/or the user input 212. As previously described, the RGBW controller 208 can use such information to control the contribution of white pixel components generated by the RGBW converter 204 in converting the RGB image data into RGBW image data for display by the RGBW display 202. Additionally, the RGBW controller 208 can use the information received from the ambient light sensor 210 and/or the user input 212 to control the contribution from the front light source and the back light source included with the transflective electrowetting display to control the overall brightness and appearance of images displayed by the RGBW display 202.

As another example, in embodiments where the RGBW display is a transparent LCD display, the RGBW controller 208 receives information from the ambient light sensor 210 and/or the user input 212 to control the contribution of white pixel components, and thereby the transparency in the display, included in the RGBW image data generated by the RGBW converter 204. In general, the transparent LCD display may continuously display a background scene. Thus, displays of RGB image data converted into RGBW image data are displayed over the background scene. Depending upon the environmental conditions, i.e., high light conditions or low light conditions, the amount of white pixel contribution in the RGBW image data needs to be adjusted so that the image being displayed over the background scene can be viewed clearly. Thus, based upon input from the ambient light sensor 210 and/or the user input 212, the contribution of the white pixel components included in the RGBW image data generated by the RGBW converter 204 may be altered. For darker environmental conditions, i.e., cloudy conditions, the contribution of white pixel components included in the RGBW image data are generally increased. For brighter environmental conditions, i.e., sunny conditions, the contribution of white pixel components included in the RGBW image data are generally lower.

Additionally, in accordance with various embodiments, the user input 212 can be used to place the image display apparatus 200 into a low power mode. For example, input from a user of the image display apparatus 200 via the user input 212 can instruct the RGBW controller 208 to place the image display apparatus 200 into a black and white mode in order to conserve power. Additionally, the input from the user input 212 can alter the contribution of the white pixel components in the RGBW image data in order to adjust overall power consumed by the RGBW display 212.

Figure 3:
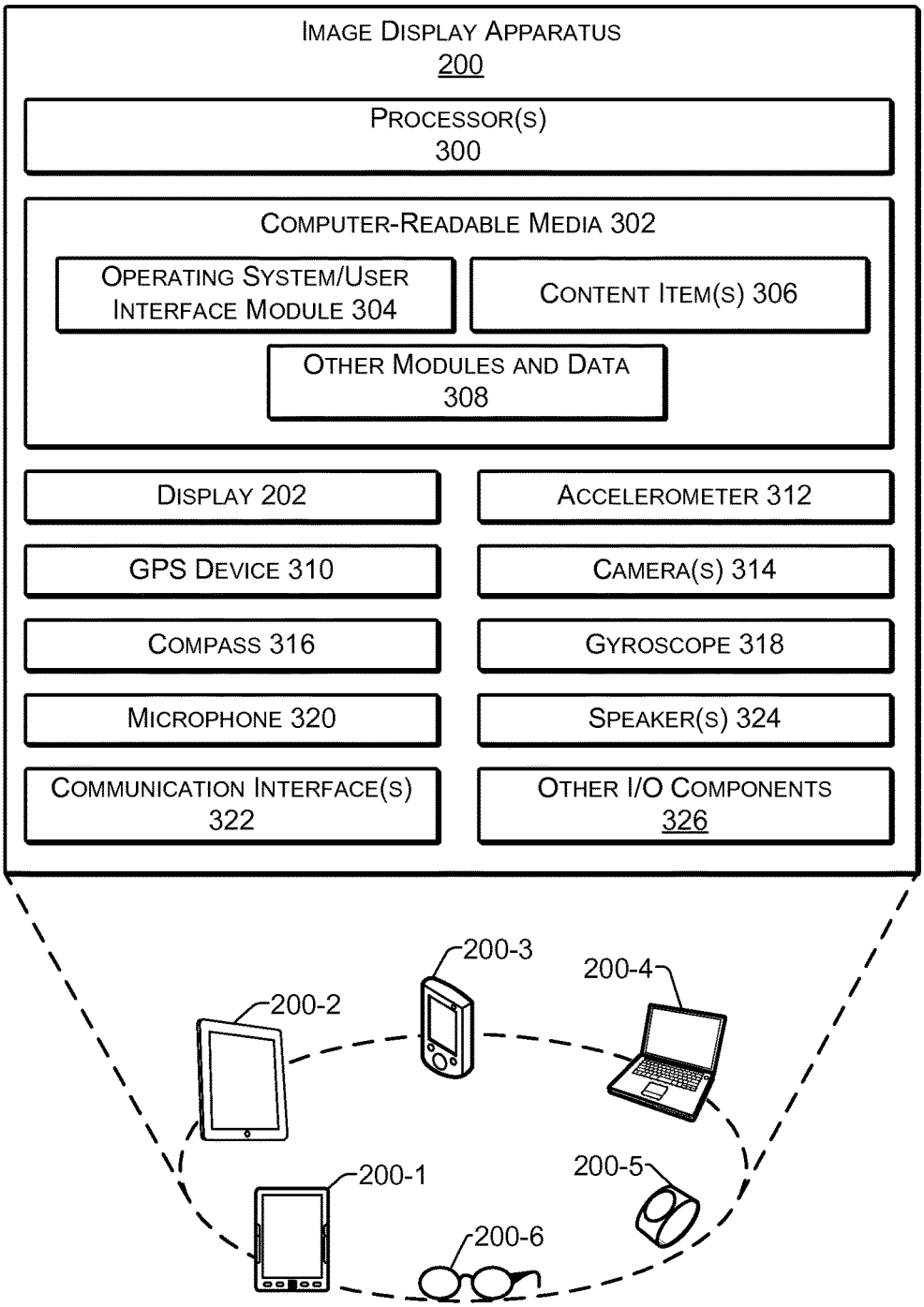
FIG. 3 illustrates select components of an example image display apparatus, according to various embodiments.

FIG. 3 illustrates select example components of an example image display apparatus 200 that may be used with the RGBW display 202 according to some implementations. The image display apparatus 200 may be implemented as any of a number of different types of electronic devices. Some examples of the image display apparatus 200 may include digital media devices and eBook readers 200-1; tablet computing devices 200-2; smart phones, mobile devices and portable gaming systems 200-3; laptop and netbook computing devices 200-4; wearable computing devices 200-5; augmented reality devices, helmets, goggles or glasses 200-6; and any other device capable of connecting with the RGBW display 202 and including a processor and memory for controlling the display according to the techniques described herein.

In a very basic configuration, the image display apparatus 200 includes, or accesses, components such as at least one control logic circuit, central processing unit, or processor 300, and one or more computer-readable media 302. Each processor 300 may itself comprise one or more processors or processing cores. For example, the processor 300 can be implemented as one or more microprocessors, microcomputers, microcontrollers, digital signal processors, central processing units, state machines, logic circuitries, and/or any devices that manipulate signals based on operational instructions. In some cases, the processor 300 may be one or more hardware processors and/or logic circuits of any suitable type specifically programmed or configured to execute the algorithms and processes described herein. The processor 300 can be configured to fetch and execute computer-readable instructions stored in the computer-readable media 302 or other computer-readable media. In accordance with various embodiments, one or more of the processors 300 serves as the RGBW converter 204 and the RGBW controller 208.

Depending on the configuration of the image display apparatus 200, the computer-readable media 302 may be an example of tangible non-transitory computer storage media and may include volatile and nonvolatile memory and/or removable and non-removable media implemented in any type of technology for storage of information such as computer-readable instructions, data structures, program modules or other data. The computer-readable media 302 may include, but is not limited to, RAM, ROM, EEPROM, flash memory or other computer-readable media technology, CD-ROM, digital versatile disks (DVD) or other optical storage, magnetic cassettes, magnetic tape, solid-state storage and/or magnetic disk storage. Further, in some cases, the image display apparatus 200 may access external storage, such as RAID storage systems, storage arrays, network attached storage, storage area networks, cloud storage, or any other medium that can be used to store information and that can be accessed by the processor 300 directly or through another computing device or network. Accordingly, the computer-readable media 302 may be computer storage media able to store instructions, modules or components that may be executed by the processor 300.

The computer-readable media 302 may be used to store and maintain any number of functional components that are executable by the processor 300. In some implementations, these functional components comprise instructions or programs that are executable by the processor 300 and that, when executed, implement operational logic for performing the actions attributed above to the image display apparatus 200, such as, for example, actions attributed to the RGBW converter 204 and the RGBW controller. Functional components of the image display apparatus 200 stored in the computer-readable media 302 may include the operating system and user interface module 304 for controlling and managing various functions of the image display apparatus 200, and for generating one or more user interfaces on the RGBW display 202 of the image display apparatus 200.

In addition, the computer-readable media 302 may also store data, data structures and the like, that are used by the functional components. For example, data stored by the computer-readable media 302 may include user information and, optionally, one or more content items 306. Depending on the type of the image display apparatus 200, the computer-readable media 302 may also optionally include other functional components and data, such as other modules and data 308, which may include programs, drivers and so forth, and the data used by the functional components. Further, the image display apparatus 200 may include many other logical, programmatic and physical components, of which those described are merely examples that are related to the discussion herein. Further, while the figures illustrate the functional components and data of the image display apparatus 200 as being present on the image display apparatus 200 and executed by the processor 300 on the image display apparatus 200, it is to be appreciated that these components and/or data may be distributed across different computing devices and locations in any manner.

FIG. 3 further illustrates examples of other components that may be included in the image display apparatus 200. Such examples include various types of sensors, which may include a GPS device 310, an accelerometer 312, one or more cameras 314, a compass 316, a gyroscope 318, a microphone 320, and so forth.

The image display apparatus 200 may further include one or more communication interfaces 322, which may support both wired and wireless connection to various networks, such as cellular networks, radio, Wi-Fi networks, close-range wireless connections, near-field connections, infrared signals, local area networks, wide area networks, the Internet, and so forth. The communication interfaces 322 may further allow a user to access storage on or through another device, such as the remote computing device 202, a network attached storage device, cloud storage, or the like.

The image display apparatus 200 may further be equipped with one or more speakers 324 and various other input/output (I/O) components 326. Such I/O components 326 may include a touchscreen and various user controls (e.g., buttons, a joystick, a keyboard, a keypad, etc.), a haptic or tactile output device, connection ports, physical condition sensors, and so forth. For example, the operating system 304 of the image display apparatus 200 may include suitable drivers configured to accept input from a keypad, keyboard, or other user controls and devices included as the I/O components 326. Additionally, the image display apparatus 200 may include various other components that are not shown, examples of which include removable storage, a power source, such as a battery and power control unit, a PC Card component, and so forth.

Various instructions, methods and techniques described herein may be considered in the general context of computer-executable instructions, such as program modules stored on computer storage media and executed by the processors herein. Generally, program modules include routines, programs, objects, components, data structures, etc., for performing particular tasks or implementing particular abstract data types. These program modules, and the like, may be executed as native code or may be downloaded and executed, such as in a virtual machine or other just-in-time compilation execution environment. Typically, the functionality of the program modules may be combined or distributed as desired in various implementations. An implementation of these modules and techniques may be stored on computer storage media or transmitted across some form of communication.

Figure 4:
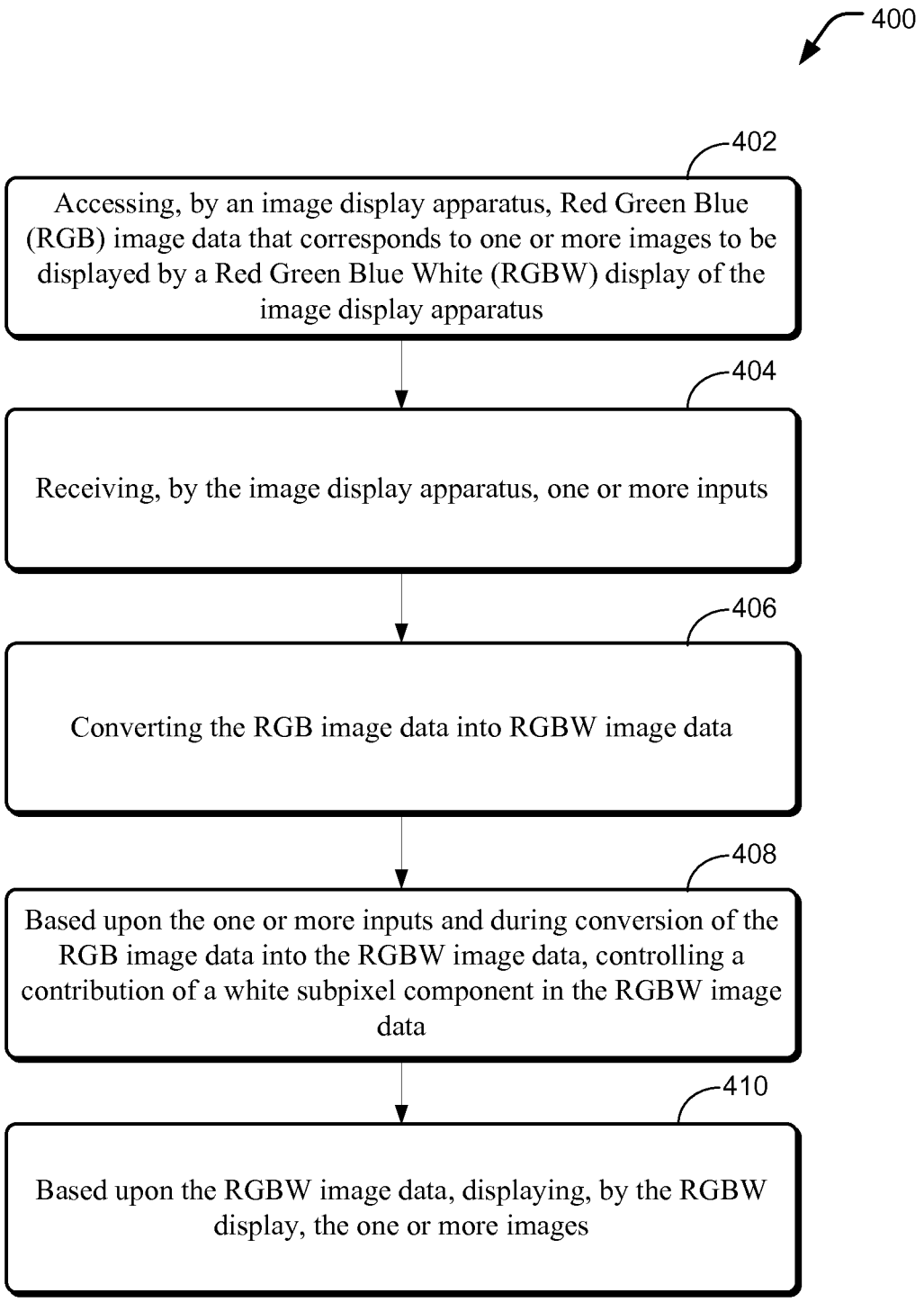
FIG. 4 is a flow diagram of an example method for conversion of RGB image data into RGBW image data for display by an image display apparatus, according to various embodiments.

FIG. 4 is flow diagram of an illustrative method incorporating techniques described herein, of which one or more steps may be implemented by one or more processors. This method (as well as other methods, processes and techniques described throughout) is illustrated as a logical flow graph, each operation of which represents a sequence of operations that can be partly or wholly implemented in hardware, software, or a combination thereof. In the context of software, the operations represent computer-executable instructions stored on one or more tangible computer-readable storage media that, when executed by one or more processors, perform the recited operations. Generally, computer-executable instructions include routines, programs, objects, components, data structures, and the like that perform particular functions or implement particular abstract data types. The order in which the operations are described is not intended to be construed as a limitation, and any number of the described operations can be combined in any order and/or in parallel to implement the processes. Furthermore, while the architectures and techniques described herein have been described with respect to servers and user equipments, the architectures and techniques are equally applicable to processors and processing cores in other environments and computing devices.

FIG. 4 is a flow diagram of an example method 400 for conversion of RGB image data into RGBW image data for display by an image display apparatus, e.g., image display apparatus 200. At 402, an image display apparatus accesses Red Green Blue (RGB) image data that corresponds to one or more images to be displayed by a Red Green Blue White (RGBW) display of the image display apparatus. At 404, the image display apparatus receives one or more inputs. At 406, the RGB image data is converted into RGBW image data. At 408, based upon the one or more inputs and during conversion of the RGB image data into RGBW image data, a contribution of a white subpixel component in the RGBW image data is controlled. At 410, the RGBW display displays the one or more images.

CONCLUSION

Although the subject matter has been described in language specific to structural features and/or methodological acts, it is to be understood that the subject matter defined in the appended claims is not necessarily limited to the specific features or acts described. Rather, the specific features and acts are disclosed as illustrative forms of implementing the claims.

One skilled in the art will realize that a virtually unlimited number of variations to the above descriptions are possible, and that the examples and the accompanying figures are merely to illustrate one or more examples of implementations.

It will be understood by those skilled in the art that various other modifications can be made, and equivalents can be substituted, without departing from claimed subject matter. Additionally, many modifications can be made to adapt a particular situation to the teachings of claimed subject matter without departing from the central concept described herein. Therefore, it is intended that claimed subject matter not be limited to the particular embodiments disclosed, but that such claimed subject matter can also include all embodiments falling within the scope of the appended claims, and equivalents thereof.

In the detailed description above, numerous specific details are set forth to provide a thorough understanding of claimed subject matter. However, it will be understood by those skilled in the art that claimed subject matter can be practiced without these specific details. In other instances, methods, devices, or systems that would be known by one of ordinary skill have not been described in detail so as not to obscure claimed subject matter.

Reference throughout this specification to "one embodiment" or "an embodiment" can mean that a particular feature, structure, or characteristic described in connection with a particular embodiment can be included in at least one embodiment of claimed subject matter. Thus, appearances of the phrase "in one embodiment" or "an embodiment" in various places throughout this specification are not necessarily intended to refer to the same embodiment or to any one particular embodiment described. Furthermore, it is to be understood that particular features, structures, or characteristics described can be combined in various ways in one or more embodiments. In general, of course, these and other issues can vary with the particular context of usage. Therefore, the particular context of the description or the usage of these terms can provide helpful guidance regarding inferences to be drawn for that context.

What is claimed is:

1. An image display apparatus comprising:
- a Red Green Blue White (RGBW) display that is configured to display images based at least in part upon RGBW image data;
- one or more of a front light source or a back light source;
- an ambient light sensor;
- a user input device; and
- an image processor comprising:
  - an RGBW converter that is configured to convert Red Green Blue (RGB) image data into the RGBW image data; and
  - an RGBW controller that is configured to control a contribution of a white subpixel component in the RGBW image data output by the RGBW converter based at least in part upon information from the ambient light sensor and information from the user input device to adjust a level of light output by one or more of the front light source or the back light source and to increase or decrease brightness of resulting images displayed.

2. The image display apparatus of claim 1, wherein the RGBW controller is further configured to control, based at least in part upon one or more of the information from the ambient light sensor or the user input device, a contribution of RGB subpixel components in the RGBW image data output by the RGBW converter.

3. The image display apparatus of claim 1, wherein:
- the RGBW display is a reflective display;
- when the ambient light sensor senses that an environment that includes the image display apparatus is well-lit, the RGBW controller decreases the contribution of the white subpixel component in the RGBW image data output by the RGBW converter; and
- when the ambient light sensor senses that the environment that includes the image display apparatus is darker, the RGBW controller increases the contribution of the white subpixel component in the RGBW image data output by the RGBW converter.

4. The image display apparatus of claim 1, wherein:
- the RGBW display is a transmissive display;
- when the ambient light sensor senses that an environment that includes the image display apparatus is well-lit, the RGBW controller increases the contribution of the white subpixel component in the RGBW image data output by the RGBW converter; and
- when the ambient light sensor senses that the environment that includes the image display apparatus is darker, the RGBW controller decreases the contribution of the white subpixel component in the RGBW image data output by the RGBW converter.

5. The image display apparatus of claim 1, wherein the one or more of the front light source or the back light source is electronically coupled to the RGBW controller.

6. An image display apparatus comprising:
- a Red Green Blue White (RGBW) display that is configured to display images based at least in part upon RGBW image data;
- one or more of a front light source or a back light source;
- an image processor comprising:
  - an RGBW converter that is configured to convert Red Green Blue (RGB) image data into the RGBW image data; and
  - an RGBW controller that is configured to control a contribution of a white subpixel component in the RGBW image data output by the RGBW converter based at least in part upon one or more inputs;
- an ambient light sensor coupled to the RGBW controller; and
- a user input device;
- wherein the one or more inputs comprise information from the ambient light sensor and the user input device to adjust, by the RGBW controller, a level of light output by one or more of the front light source or the back light source and to increase or decrease brightness of resulting images displayed, and wherein the one or more inputs are used by the RGBW controller for adjusting the contribution of the white subpixel component in the RGBW image data output by the RGBW converter.

7. The image display apparatus of claim 6, wherein the RGBW display comprises one of a liquid crystal display (LCD) or an electrowetting display (EWD).

8. The image display apparatus of claim 7, wherein the RGBW controller is further configured to increase the contribution of the white subpixel component in the RGBW image data output by the RGBW converter based at least in part upon the information from the ambient light sensor indicating that an environment that includes the image display apparatus is well-lit.

9. The image display apparatus of claim 6, wherein the RGBW controller is further configured to control, based at least in part upon the information from the ambient light sensor and the user input device, a contribution of RGB subpixel components in the RGBW image data output by the RGBW converter.

10. The image display apparatus of claim 6, wherein:

the RGBW display comprises a liquid crystal display (LCD); and the one or more inputs comprise the information from ambient light sensor and the user input device for adjusting, by the RGBW controller, the contribution of the white subpixel component in the RGBW image data to thereby control a level of transparency in the RGBW image data output by the RGBW converter, wherein the level of transparency in the RGBW image data is with respect to a background image displayed by the LCD.

11. The image display apparatus of claim 6, wherein the RGBW controller is coupled to the one or more of the front light source or the back light source and wherein the RGBW display is one of a reflective display or a transmissive display.

12. A method comprising:

accessing, by an image display apparatus, Red Green Blue (RGB) image data that corresponds to one or more images to be displayed by a Red Green Blue White (RGBW) display of the image display apparatus;

receiving, by the image display apparatus, one or more inputs comprising information from an ambient light sensor and information from a user input device;

converting the RGB image data into RGBW image data;

controlling a contribution of a white subpixel component in the RGBW image data based at least in part upon the information from the ambient light sensor and the information from the user input device to adjust, by the RGBW controller, a level of light output by one or more of a front light source or a back light source and to increase or decrease brightness of resulting images displayed, and during conversion of the RGB image data into the RGBW image data; and displaying, by the RGBW display, the one or more images based at least in part upon the RGBW image data.

13. The method of claim 12, wherein:

the RGBW display comprises one of a liquid crystal display or an electrowetting display (EWD); and controlling the contribution of the white subpixel component in the RGBW image data comprises, based at least in part upon at least the information from the ambient light sensor and the information from the user input device, adjusting the contribution of the white subpixel component in the RGBW image data.

14. The method of claim 13, wherein controlling the contribution of a white subpixel component in the RGBW image data comprises increasing the contribution of the white subpixel component based at least in part upon the information from the ambient light sensor indicating that an environment that includes the image display apparatus is well-lit.

15. The method of claim 12, wherein:

the RGBW display comprises a liquid crystal display (LCD); and controlling the contribution of the white subpixel component in the RGBW image data comprises, based at least in part upon the information from the user input device, adjusting the contribution of the white subpixel component to thereby control a level of transparency in the RGBW image data, wherein the level of transparency in the RGBW image data is with respect to a background image displayed by the LCD.

16. The method of claim 12, wherein:

the RGBW display comprises a liquid crystal display (LCD); and controlling the contribution of the white subpixel component in the RGBW image data comprises, based at least in part upon the information from the ambient light sensor, adjusting the contribution of the white subpixel component to thereby control a level of transparency in the RGBW image data, wherein the level of transparency in the RGBW image data is with respect to a background image displayed by the LCD.

17. The method of claim 16, wherein the method further comprises:

based at least in part upon the information from the user input device, further adjusting a contribution of a white subpixel component to thereby further control the level of transparency in the RGBW image data.

18. The method of claim 12, further comprising, based at least in part upon the information from the ambient light sensor and the information from the user input controlling a contribution of RGB subpixel components in the RGBW image data.

19. The method of claim 18, wherein:

the RGBW display comprises one of a liquid crystal display (LCD) or an electrowetting display (EWD); and controlling the contribution of the white subpixel component and controlling the contribution of the RGB subpixel components comprise, based at least in part upon the information from the ambient light sensor and the information the user input device, adjusting at least one of the contribution of the white subpixel component in the RGBW image data or the contribution of the RGB subpixel components in the RGBW image data.

20. The method of claim 12, wherein the RGBW controller is electronically coupled to the one or more of the front light source or the back light source and wherein the RGBW display is a transflective display.

* * * * *